US006620065B2

(12) United States Patent
Clabough

(10) Patent No.: US 6,620,065 B2
(45) Date of Patent: Sep. 16, 2003

(54) PITCHER'S BOX PITCHER TRAINING SYSTEM

(76) Inventor: John D. Clabough, 11703 Nobility Dr., Staford, TX (US) 77477

( * ) Notice: Subject to any disclaimer, the term of this patent is extended or adjusted under 35 U.S.C. 154(b) by 2 days.

(21) Appl. No.: 09/759,289

(22) Filed: Jan. 11, 2001

(65) Prior Publication Data

US 2002/0091021 A1 Jul. 11, 2002

(51) Int. Cl.[7] ..... A63B 69/00; A63B 63/00

(52) U.S. Cl. ..... 473/454; 473/439; 273/343; 273/369

(58) Field of Search ..... 473/420, 422, 473/435–439, 454–456, 478, 173, 197, 423, FOR 104, 109, 213

(56) References Cited

U.S. PATENT DOCUMENTS

| | | | | | |
|---|---|---|---|---|---|
| 1,598,865 | A | * | 9/1926 | Limerick | 473/595 |
| 2,580,799 | A | * | 1/1952 | Lauterbach | 473/476 |
| 3,039,770 | A | * | 6/1962 | Ferretti | 273/402 |
| 3,583,703 | A | * | 6/1971 | Brown et al. | 473/456 |
| 3,633,909 | A | * | 1/1972 | Doynow | 473/454 |
| 3,675,922 | A | * | 7/1972 | Nieland | 473/420 |
| 3,820,787 | A | * | 6/1974 | Heinbigner | 473/439 |
| 4,092,023 | A | * | 5/1978 | Hazen | 273/369 |
| 4,295,648 | A | * | 10/1981 | Stromback | 273/402 |
| 4,473,227 | A | * | 9/1984 | Klaus | 273/DIG. 30 |
| 5,080,375 | A | * | 1/1992 | Moosavi | 473/478 |
| 5,320,343 | A | * | 6/1994 | McKinney | 473/417 |
| 5,348,291 | A | * | 9/1994 | Scully | 473/454 |
| 5,439,211 | A | * | 8/1995 | Drabowsky | 473/456 |
| 5,484,145 | A | * | 1/1996 | Shriver | 473/454 |
| 5,505,443 | A | * | 4/1996 | Padilla | 473/417 |
| 5,746,671 | A | * | 5/1998 | Ritchie | 473/454 |
| 6,093,120 | A | * | 7/2000 | Luke, Jr. | 473/435 |
| 6,220,976 | B1 | * | 4/2001 | Kaiser et al. | 273/343 |

* cited by examiner

*Primary Examiner*—Paul T. Sewell
*Assistant Examiner*—Mitra Aryanpour
(74) *Attorney, Agent, or Firm*—Richard J. Tholstrup

(57) ABSTRACT

An invention relating to a device and method for training all types of pitchers. The coach observes a pitch, approximating its natural apogee. This point should be at about 12 to 15 feet from the mound/release point. The Pitcher's Box pitcher training system is placed at the approximate point of apogee and adjustments in height and width are made to accommodate the ability of the pitcher, placing the target object as near as possible to the apogee height with the target object being no closer than 12 inches to the top of the enclosed section itself. The coach instructs the pitcher to pitch at and through the target object to the target zone at home plate. The pitcher is able to remove the stigma of distance from the pitch, enabling the subject to work on mechanics, conditioning, strength and repetition. For advanced work by accomplished subjects more than one Pitcher's Box can be used in tandem to establish control and placement, desired movement, and to map movement and reactions. The use of a visual benchmark will allow a coach to evaluate changes in mechanics, rhythm and delivery. In the case of advanced usage, multiple target object usage and optional side markers are accommodated.

1 Claim, 2 Drawing Sheets

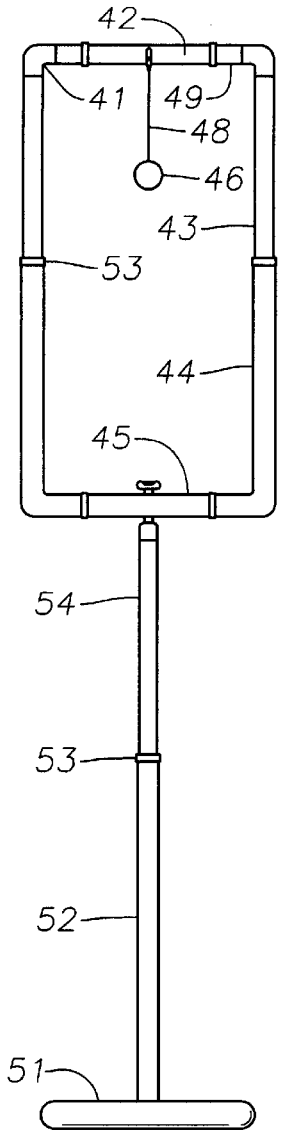
Fig. 1
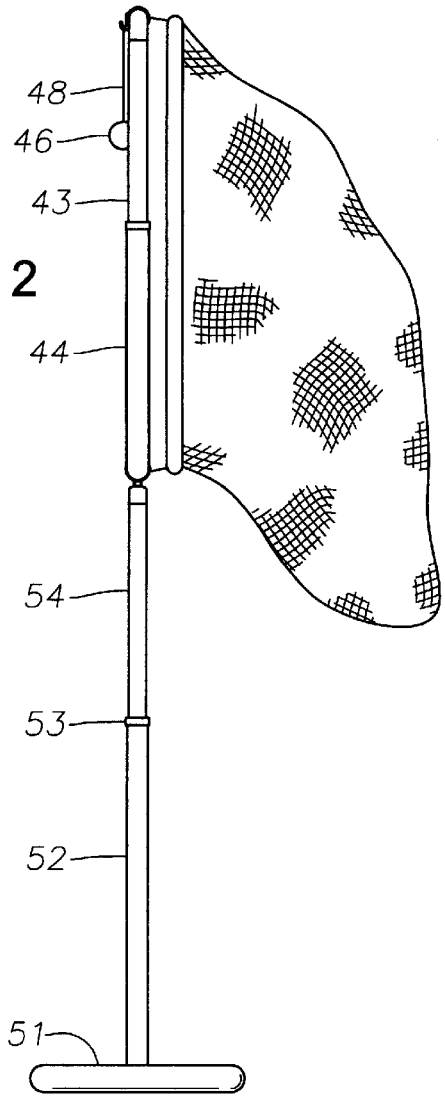
Fig. 2
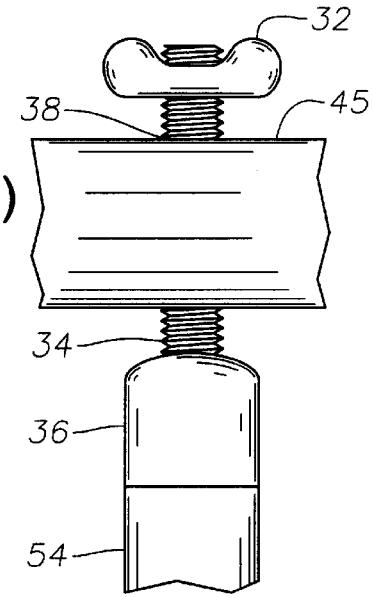
Fig. 3 (30)
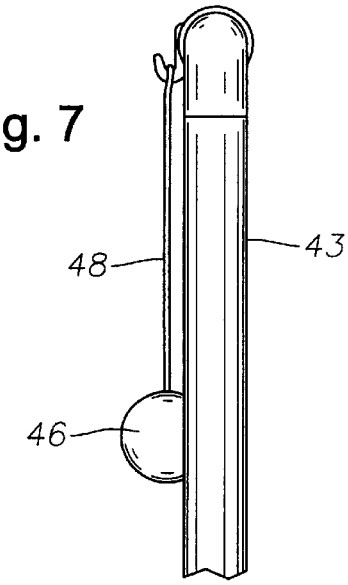
Fig. 7

Fig. 4 (40)
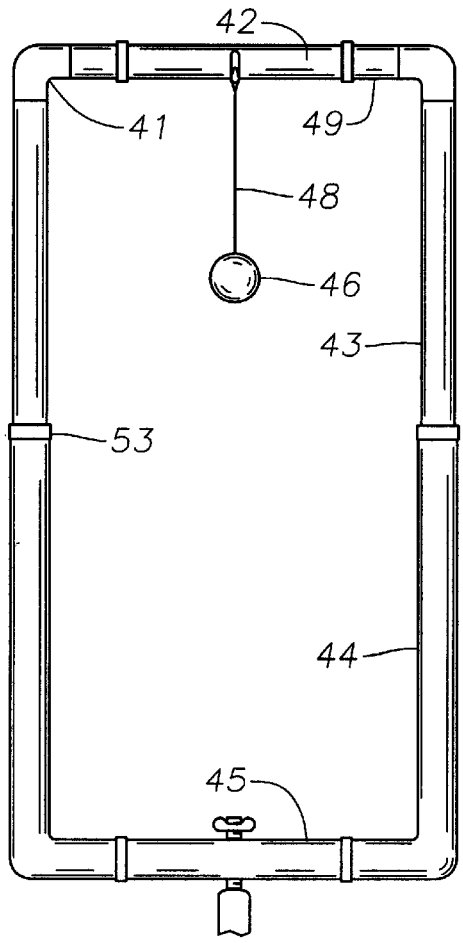
Fig. 5 (50)
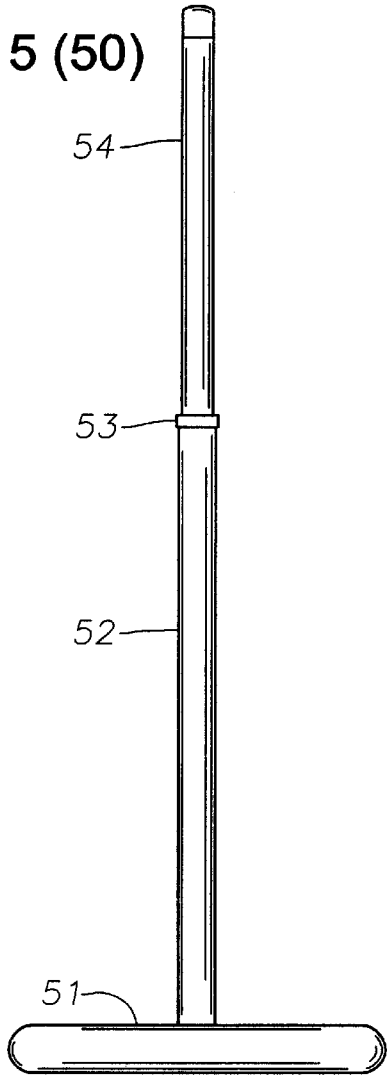
Fig. 6
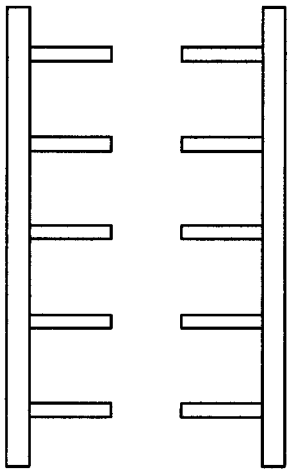
Fig. 8
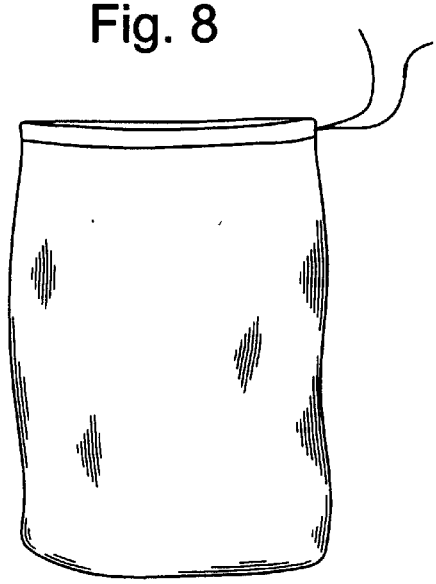

PITCHER'S BOX PITCHER TRAINING SYSTEM

BACKGROUND

1. Field of the Invention

The present invention relates to a novel system for approximating and developing the natural release and apogee of a reasonably accurate pitch.

2. Description of Related Art

The problem to which this invention is directed is developing a consistent apogee through a consistent release of pitch, thereby allowing a pitcher to visualize his/her "spot" during game conditions. Most pitcher training systems place the equipment at the home plate. Specifically, these systems work on keeping the ball within the strike zone. The major portion of the pitch, which is the distance traveled from the ball's release at the mound to home plate to is usually ignored by training systems.

The system employed in U.S. Pat. No. 4,473,227 to Klaus, Sep. 25, 1984 consists of a vertical support frame set up temporarily at the front edge of home plate. The pitcher attempts to throw the baseball from his mound position to the catcher behind home plate through the device which outlines the strike zone area. This patent does nothing specifically to develop a consistent release and degree of apogee on the pitched ball.

The system employed in U.S. Pat. No. 5,746,671 to Ritchie, May 5, 1998 attempts to provide an alley through which to throw. Various targets are positioned on a tarpaulin. Lead lines, which are attached to the frame beneath the targets, are extended out toward the pitcher. As described by the patent, the apparatus employs no training system to develop a consistent degree of apogee on the pitched ball. The system employed in U.S. Pat. No. 3,583,703 to Brown and Kemph, Jun. 8, 1971 consists of a target simulating an average strike zone. This works on the end result and not the apogee or path of the pitch.

The system employed in U.S. Pat. No. 4,092,023 to Hazen, May 30, 1978 passes a ball or kick through a moving target to effectuate timing and accuracy. Timing and accuracy are not the primary purpose of the instant invention. The Pitcher's Box teaches the user to develop a consistent release and apogee first and then other techniques not in the scope of the current invention will be used to develop timing and accuracy.

The system employed in U.S. Pat. No. 5,439,211 to Drabowsky, Aug. 8, 1995 is placed at home plate. Again, this system concentrates on the end result, not the approach and path of the pitch as does the Pitcher's Box specifically.

Objects and Advantages

Accordingly, several objects and advantages of the present invention are consistent apogees and ball release points, spot visualization, and target approximating. One of the disadvantages discussed in the Description of Related Art is that most of the other systems concentrate on the end result of a pitch. The present invention places it's emphasis on the apogee of the pitch, therefore, it is necessary to place the employed equipment between home plate and the pitcher's mound. A targeting object suspended inside of an enclosed vertically supported frame, section, or structure is provided for the pitcher to direct the throw once his natural apogee is observed. Through continued use the target object can be adjusted for the optimal apogee for an accurate pitch.

As outlined, this system is observant of the path taken to the end result, not the end result itself.

The referenced art provides no means for visualizing the optimal placement of the ball in attaining the most accurate apogee for delivering the ball in the batter's strike zone. The target object placed inside the enclosed structure provides a tool for visualizing where the pitch should be delivered. Generally, targets that are placed closer to a pitcher are easier and more comfortable to strike. Once the target is moved, the pitcher may still visualize the near target aiding the pitcher's release point timing to achieve the desired apogee on the pitch.

Approximating the target through practice, a pitcher can achieve a consistent apogee. The pitcher can then adjust his timing and accuracy around the consistent apogee. Once the path of the ball has become consistent, the end result of the ball can more easily be adjusted for placement in the batter's strike zone.

It is another object of the present invention to provide a new and improved apparatus for training a pitcher which has all the advantages of the prior art and none of the disadvantages.

It is a further object of the present invention to provide a new and improved apparatus for training a pitcher which may be easily and efficiently manufactured and marketed. Another object of the present invention is to provide a new and improved apparatus for pitcher training which is of durable and reliable construction.

An even further object of the present invention is to provide a new and improved apparatus for training a pitcher which is susceptible of a low cost of manufacture with regard to both materials and labor, and which accordingly is then susceptible of low prices of sale to the consuming public, thereby making such apparatus for training a pitcher economically available to the buying public.

DRAWING FIGURES

FIG. 1 shows a plan and elevational perspective view of the basic version of the Pitcher's Box.

FIG. 2 shows side a perspective view of the Pitcher's Box and an optional net for indoor work.

FIG. 3 shows the pedestal connector assembly, consisting of an affixed stud, dual thrust bearings to allow for a full 360 degree rotation, and a wing nut.

FIG. 4 shows the upper enclosed section with lateral and vertical adjustments and connection members.

FIG. 5 shows the pedestal base with a mounting connector, and height adjuster.

FIG. 6 shows an optional side marker.

FIG. 7 shows the target object attached to the top enclosed section bar.

FIG. 8 shows the optional carrying bag.

REFERENCE NUMERALS IN DRAWINGS 30 pedestal connector assembly
32 wing-nut
34 fixed stud
36 dual thrust bearing
38 hole
40 enclosed section
41 joint
42 top bar -continued

| |
|---|
| 43 upper side bar |
| 44 lower side bar |
| 45 bottom bar |
| 46 target object |
| 48 lanyard |
| 49 short bar |
| 50 base |
| 51 pedestal base |
| 52 bottom pedestal shaft |
| 53 connection member |
| 54 top pedestal shaft |

SUMMARY

In accordance with the present invention, an upper enclosed section displaying a targeting object supported by a base pedestal that is fully adjustable vertically and horizontally.

Description—FIGS. 1 to 8

A typical embodiment of the present invention is illustrated in FIGS. 1 and 5. FIG. 5 illustrates the supporting base unit 50 of the present invention. The base unit 50 comprises of the pedestal base 51, bottom pedestal shaft 52, connection member 53, and top pedestal shaft 54. The pedestal base 51 acts as the rigid and stable supporting structure for the present invention. The base 51 is hollow and fillable with ballast. The bottom pedestal shaft 52 is joined to base 51. Shaft 52 contains a height adjuster; this allows the Pitcher's Box pitcher training system to be raised or lowered according to each individuals pitch. Shaft 52 is connected to the top pedestal shaft 54 by a compression member 53. The top shaft 54 slides vertically within the bottom shaft 52 at the compression member 53. The top pedestal shaft 54 houses the mounting connector or dual thrust bearing 36 on the end opposite of the compression member 53.

Additional embodiments are shown in FIG. 3. FIG. 3, the pedestal connector assembly 30, consists of a wingnut 32, one fixed stud 34, one dual thrust bearing 36, a bottom bar 45, and the top pedestal shaft 54; this connector assembly 30 joins the base 50 with the enclosed section 40. The bottom bar 45 of the enclosed section 40 contains a hole 38 whereby the fixed stud 34 penetrates and is secured in place by the wingnut 32. The stud 34 is permanently affixed to the dual thrust bearing 36. Bearing 36 is capable of rotating for a full 360 degrees.

Additional embodiments are shown in FIG. 4. FIG. 4, the enclosed section 40, consists of four joints 41, one top bar 42, one bottom bars 45, two upper side bars 43, two lower side bars 44, four short bars 49, one ball/disc 46, one lanyard 48, and six connection members 53. The enclosed section 40 is the part of the present, invention where the pitched ball will pass striking the hanging target object 46. The enclosed section 40 is fully adjustable vertically and horizontally via the connection members 53. With the base unit 50 assembled to the pedestal connector assembly 30, the enclosed section 40 is extended horizontally and equally from this point.

One connection member 53 is placed at either extreme of the bottom bar 45 to which a short bar 49 is attached and then joined to the short bar 49 is one joint 41. The bottom bar 45 allows for horizontal adjustment. A lower side bar 44 is joined perpendicular to the short bar 49 by the joint 41. Attached at the opposite end of the lower bar 44 is a upper side bar 43 by a connection member 53. The upper bar 43 sides within the lower bar 44 to adjust the vertical alignment of the present invention. The upper bar 43 is joined perpendicularly to another short bar 49 by a joint 41. The short bar 49 is then attached to the top bar 42 by a connection member 43. The top portion of the present invention is adjustable horizontally at the connection members 53. The enclosed section is complete.

The top bar 42 has a hook attached at its center. The lanyard 48 is placed on the targeting track; the target object 46 is attached to the lanyard 48. The lanyard 48 and target object 46 assembly are suspended approximately in the center of the enclosed section 40. The height and/or horizontal placement of the target object 46 is fully adjustable.

Operation—FIGS. 1, 3, 4, 5

In using the pitcher training system or Pitcher's Box, one must first determine a pitcher's natural pitch apogee. The present invention may then be fine tuned or adjusted for the ideal apogee of each individual pitcher's ability. The present invention FIG. 1 will be placed between home plate and the pitcher's mound. The height of the Pitcher's Box pitcher training system may be adjusted at the connection member 53 on the base unit 50 or on the enclosed section 40 at the connection members 53 on the side bars 43, 44. The greatest degree of vertical adjustment will be accomplished at the base unit 50.

Displayed in FIGS. 1 and 4, the vertical width may be adjusted using the connection members located on the bottom bar 45 and the top bar 42. This serves to narrow the targeting channel of the enclosed section 40 as a pitcher advances. Also, the enclosed section 40 may rotate 360 degrees at the pedestal connector assembly. The dual thrust bearing 36 allows the enclosed section 40 to pivot 360 degrees.

Conclusion, Ramifications, and Scope

Accordingly, the reader will see that the Pitcher's Box pitcher training system can be used to train pitchers of all types. The present invention is of relative light weight, fully adjustable, and easily assembled. In addition, the system focuses its training on the release of the pitch to develop a consistent apogee. Furthermore, the Pitcher's Box pitcher training system has the additional advantages in that

- it permits a pitcher to concentrate on and visualize a target closer to the mound, overcoming a preoccupation with distance.
- it allows a trainer to adjust the present invention as the pitcher advances in skill.
- it provides a method for learning where one's optimal release point is located.
- it provides a means for developing release timing mechanics.
- it provides a visual benchmark allowing a coach to evaluate changes in mechanics, rhythm and delivery with speed and precision.
- it allows advanced pitchers to develop using multiple target objects and optional side markers.
- it provides a means for inside convention facilitated by using the optional catch net and bean bag balls without damaging the indoor environment.

Although the description above contains many specificities, these should not be construed as limiting the scope of the invention but as merely providing illustration of some of the presently preferred embodiments of this invention. Many other variations are possible. For example, the enclosed section 40 can have other shapes, such as circular, oval, triangular, etc.; the pedestal base 51 may be filled with sand, water, cement, etc; the bars and shafts may be made of PVC, aluminum, steel, etc.

Thus the scope of the invention should be determined by the appended claims and their legal equivalents, rather than by the embodiments illustrated.

What is claimed is:

1. A method to train a pitcher to release and throw a ball through the apogee of the desired, reasonably accurate pitch to a predetermined target zone comprising:

a) positioning a pitcher training target device, between said pitcher and said target zone, a predetermined distance from said pitcher based on the predicted distance of the apogee of said pitch from the point of release of said ball by said pitcher;

b) said pitcher target training device comprising:

a base frame with a vertical and horizontal support;

an enclosed section releaseably attached to said base vertical support, said enclosed section comprised of a bottom horizontal bar attached to side bars which are in turn attached to a top bar;

a rotational bearing located at the point of attachment for said vertical support and said enclosed section;

a lanyard with upper and lower ends releaseably attached by said lanyard's upper end to said top bar of said enclosed section;

a target object releasably attached to the lower end of said lanyard;

a connection member on said vertical support for vertically extending said vertical support; p2 a connection member on each of the vertical side bars of said enclosed section for vertically extending each upper side bar;

a connection member on said bottom bar for horizontally extending said bottom bar horizontally; and a connection member on said top bar for horizontally extending said top bar horizontally;

c) having said pitcher throw balls at said target zone; and d) repositioning said pitcher training target device until said apogee achieved by use of said pitcher target training device results in said pitch traveling through said target zone.

* * * * *